United States Patent [19]

Meldahl

[11] 3,993,376

[45] Nov. 23, 1976

[54] FURNITURE FOR CONCEALING A WASH BASIN

[76] Inventor: Horace S. Meldahl, P.O. Box 1, Charleston, W. Va. 25321

[22] Filed: Aug. 20, 1975

[21] Appl. No.: 606,067

[52] U.S. Cl. ..... 312/228; 312/22; 312/282; 4/167

[51] Int. Cl.[2] ..... A47B 77/06; A47K 1/00

[58] Field of Search ..... 312/229, 228, 282, 231, 312/22, DIG. 33, 324, 284; 4/167; 108/38

[56] References Cited

UNITED STATES PATENTS

| | | | |
|---|---|---|---|
| 164,967 | 6/1875 | Brown | 312/228 |
| 202,257 | 4/1878 | Hale | 312/228 |
| 323,970 | 8/1885 | Stryker, Jr. | 312/228 |
| 489,951 | 1/1893 | Hartsock | 312/282 |
| 794,589 | 7/1905 | Clark | 312/282 |
| 1,369,577 | 2/1921 | Townley | 312/282 |
| 1,659,393 | 2/1928 | Dickinson et al. | 312/22 |
| 2,426,152 | 8/1947 | Meldahl | 4/167 |
| 2,664,331 | 12/1953 | Glotfelter | 312/282 |
| 2,725,274 | 11/1955 | Stivale | 312/282 |

*Primary Examiner*—Paul R. Gilliam
*Assistant Examiner*—Victor N. Sakran

[57] ABSTRACT

This disclosure relates to an article of furniture which includes the basic components of any type of furniture but additionally has incorporated therein lavatory means, such as hot and cold running water, ice water tappets, a sink, drainage means, etc. which when enclosed provide the appearance of a "normal" piece of furniture in that it cannot be determined from casual observation that the piece of furniture is other than a normal piece of furniture. The primary feature of the invention is that of forming the article of furniture with two upstanding walls and a cover having two depending walls with the walls being disassociated from each other except for performing the functions of totally enclosing a section of the article of furniture and providing a splash or drain board to a side of the article of furniture.

1 Claim, 4 Drawing Figures

FURNITURE FOR CONCEALING A WASH BASIN

Through many years many persons have developed and patented articles of furniture which in the normal condition thereof appear to be nothing more than the usual type of furniture found in homes, motels, hotels, conference halls, etc. However, such attempts at "facsimile" normal furniture have had many disadvantages, particularly in the construction and operation thereof, and basically can be observed by an uninitiated eye as being "fakes". Applicant heretofore had developed one such type of furniture and the latter is fully disclosed in U.S. Pat. No. 2,426,152 granted on Aug. 19, 1947. However, even the latter structure offered disadvantages which though overcoming most of preceding attempts at such constructions still fell short of an ideal compromise between appearance, utility and manufacturing costs, not to mention consumer appeal. Accordingly, the present invention has been evolved over many years after a careful consideration of the latter factors and has obviated many of the disadvantages, both aestheticwise and commercialwise, compared to known prior art structures.

In keeping with the present invention the novel article of furniture disclosed herein appears in all facets as just that, namely, a normal article of furniture. However, one section of the article is removable through a cover which is blended into and engineered to both functionally and aesthetically obviate all past disadvantages known in such "concealment" type furnishings.

The specific article of furniture in question typically includes any type of furniture which is broadly inclusive of a front, opposite sides, a back, a bottom, and a top with the top being divided into at least a pair of top sections. However, at this point the prior art is distinguished in that the top is divided into a pair of sections by a first upstanding wall between the front and back of the article of furniture and another wall extending along the back of the article of furniture. In combination with the latter two walls there is provided a cover defined by a top panel and two depending walls. This combination in conjunction with the disposition of a hinge in a novel area permits the overall article of furniture to appear as nothing more than a normal article of furniture while at the same time totally concealing lavatory means, such as a sink, spigots, faucets, etc., in a section of the furniture covered by the cover. Moreover, due to the disposition of the cover at a side of the article of furniture it not only provides a position at which motion is unimpeded due to position within a particular environment (against a wall, in a corner, in a center of a room, etc.,) but also serves as a splash board for water or the like which may be diverted from the basic area of the lavatory means.

With these and other features as objects in view, as will appear, an illustrated form of construction of the present invention is set forth in the accompanying drawings.

Figure 1:
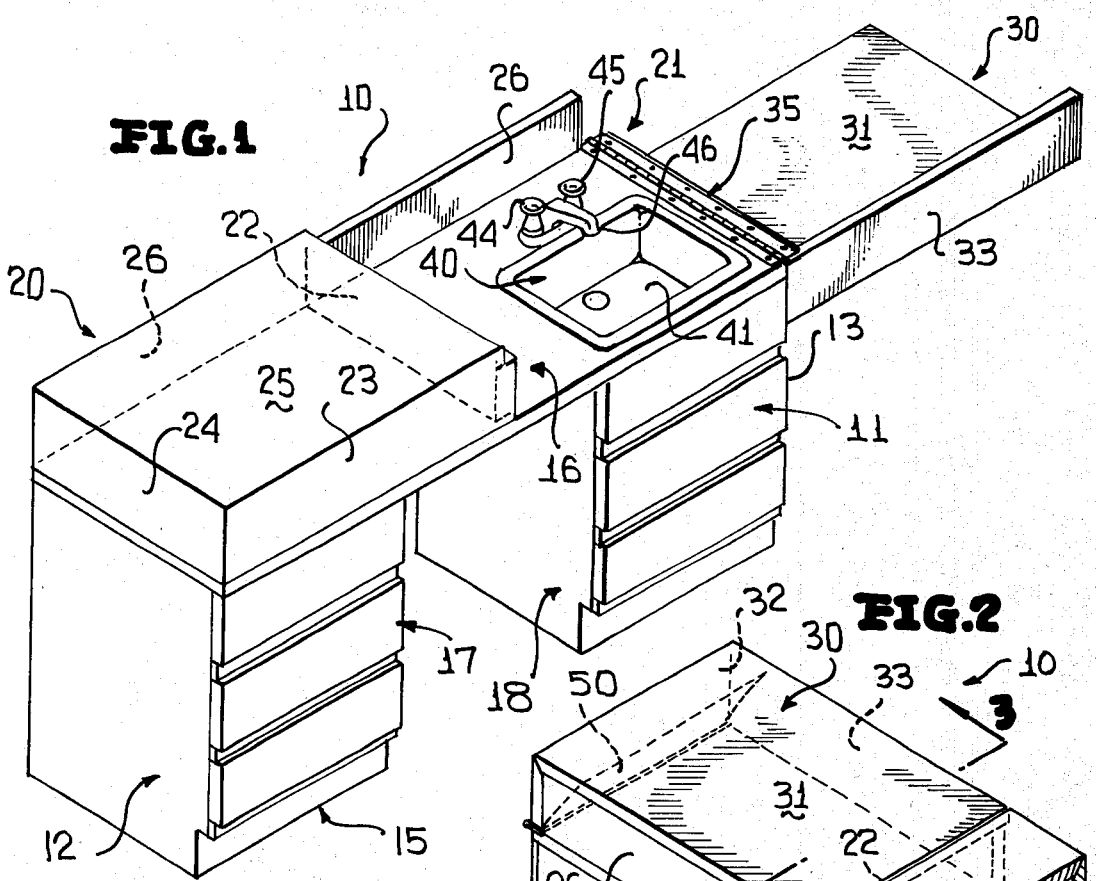
FIG. 1 is a perspective view of a novel article of furniture constructed in accordance with this invention, and illustrates the cover thereof in its opened or raised position exposing lavatory means.

Reference is first made to FIG. 1 of the drawing which illustrates an article of furniture generally designated by the reference numeral 10. The article of furniture maybe of any particular design and that illustrated is simply exemplary of any article of furniture to which the present invention might be employed. The article of furniture 10 includes a front 11, opposite sides 12, 13, a back 14, a bottom 15, and a top 16. The article of furniture 10 is illustrated as a desk, chest or the like having a pair of pedestals 17, 18, but in accordance with this invention the opening (unnumbered) between the pedestals 17, 18 can be omitted and the front 11 could simply be a continuous uninterrupted single or plural component assembly. The importance is that of recognizing that the article of furniture 10 maybe of any particular configuration known to be "conventional" and as such may be modified or constructed in accordance with this invention to provide the objectives heretofore noted.

Figure 4:
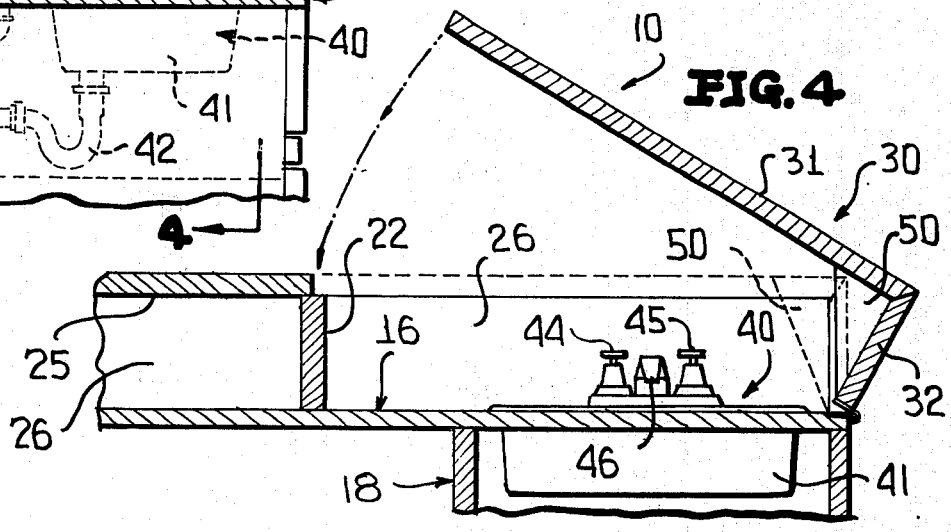
FIG. 4 is a sectional view taken generally along line 4—4 of FIG. 3, and illustrates the cover in the position between the fully opened and fully closed position thereof.

The top 16 is divided into at least a pair of top sections 20, 21 by a first upstanding wall 22 (FIGS. 1 and 4) which extends between the front 11 and the back 14. The first top section 20 is in part defined by the first upstanding wall 22, another wall 23 at the front 11, another wall 24 at the side 12, a top panel 25, and second upstanding wall means 26 which extends between the sides 12, 13. Thus the overall configuration of the first top section 20 is that of a rectangle defined by the walls 22 through 24 and 26, and the top panel 25. If desired the wall 23 may be a drawer or simply an opening by generally the first top section 20 is an immovable component of the overall piece of furniture 10.

Figure 2:
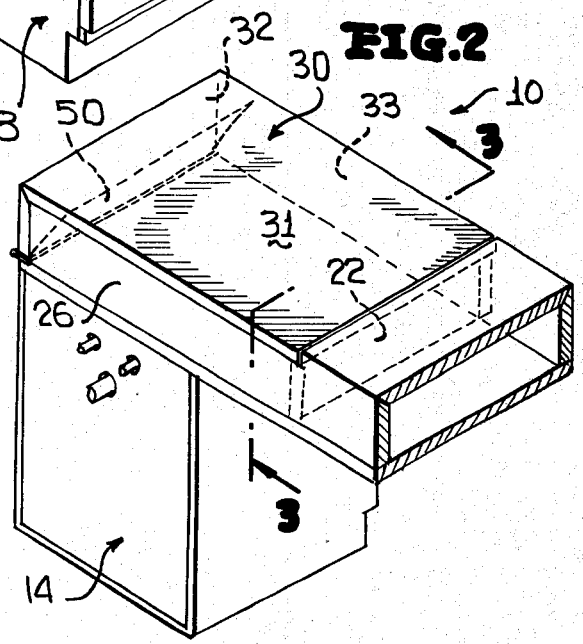
FIG. 2 is a fragmentary perspective rear view of the article of furniture illustrated in FIG. 1, and illustrates the cover thereof in its closed position.

The second top section 21 is defined by a portion of the upstanding wall 26 which extends between the upstanding wall 22 and the side 13. The second top section 21 further includes a cover, generally designated by the reference numeral 30 which is in turn defined by a top panel 31 and first and second depending wall means, 32, 33, respectively. In otherwords, the cover 30 is formed generally only of two sides 32, 33 and the top panel 31. Hinge means, generally designated by the reference numeral 35 which is preferably a piano hinge pivotally connects the cover 30 to the piece of furniture 10 at the side 13 along its upper edge (unnumbered) along the first depending wall 32 of the cover 30. Due to this hinge construction the cover 30 can be pivoted between its open or first position (FIG. 1) at which it is disposed sidewise away from the side 13 and a second or closed position (FIG. 2) at which the cover 30 overlies and covers a portion of the top 16 thereby providing the appearance of a unitized immovable part of the furniture 10 in conjunction with the first top section 20. The latter is readily apparent from FIG. 2 and also from FIG. 1 when the cover 30 in the latter figure is visualized in its closed position. In the latter position the overall piece of furniture 10 appears to be of a conventional construction, namely, immovable pieces other than the usual drawers, slides, or the like.

Figure 3:
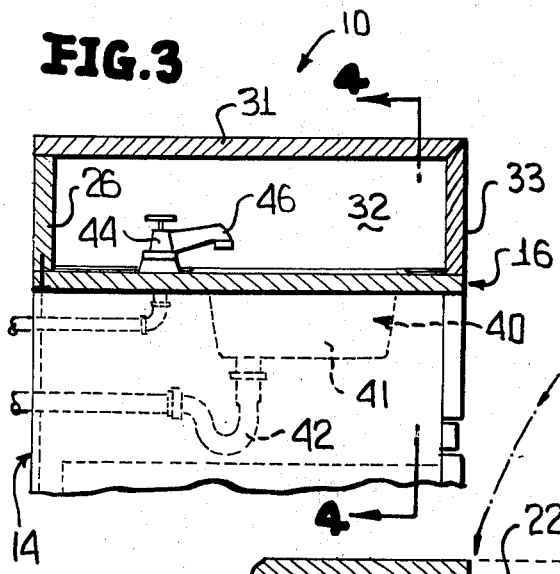
FIG. 3 is a cross-sectional view taken generally along line 3—3 of FIG. 2, and more clearly illustrates details of the cover and associated structure in the closed position of the former.

Though in the closed position the appearance of conventionality is achieved by the construction heretofore defined the article of furniture 10 is provided with lavatory means, generally designated by the reference numeral 40. The lavatory means 40 is disposed within the top 16 and in the area of the top section 21 and may include, for example, a sink or basin 41, having a drainpipe 42 (FIG. 3), hot and cold water taps 44, 45 and spigot 46, etc. Thus in the covered position of the cover 30 (FIG. 2) the lavatory means 40 (not shown in FIG. 2) is completely concealed whereas in the opened position of the cover 30 (FIG. 1) access to the lavatory means 40 is provided and the top panel 31 of the cover 30 provides a splash guard or drain board for the lavatory means 40 as does the portion of the upstanding wall 26 in the area of the top 16 before the wall 22 and the side 13. Of course, the wall 22 also provides a splash guard to the left of the lavatory means 40, as viewed in FIG. 1.

In summary, the article of furniture 10 provides a very economic construction in which there is an overall appearance of immobility in overall construction except for drawers, slides, etc. yet within the area covered by the cover 30 there can be located the lavatory means 40. However, the construction is such that the upstanding wall 26 may run the length of the piece of furniture 10 from side 12 to side 13, and thus the only "break" between the sides 12, 13 is the upstanding wall 22. Thus, from the left of the wall 12 the difference between a conventional piece of furniture and that of this invention remains substantially unchanged yet the walls 22, 26 provide upper bearing surfaces for the unreinforced edges of the top panel 31, as is most readily apparent from FIGS. 2 through 4. Likewise, the wall 22, 26 provide splash guards to the left and rearward, as viewed in FIG. 1, and the cover 30 functions as a drain board or the like in its upstanding opened position (FIG. 1). Thus the overall piece of furniture constitutes a vast improvement and a novel and unobvious advance over prior art attempts in this area.

A triangular strip 50 (FIG. 4) is provided along the wall 32 to provide rigidity and strength thereto as well as to keep splash water from accumulating in the area of the hinge 35 when the cover 30 is tilted or pivoted to its upstanding opened position. The latter position is shown fully opened in FIG. 1 but, of course, the cover 30 may be limited in its hinging to any desired position between the horizontal position illustrated in FIG. 1 or other angles toward normal, and a suitable brace (not shown) may be provided to retain the cover 30 in any particular desired opened position.

While preferred forms and arrangement of parts have been shown in illustrating the invention, it is to be clearly understood that various changes in details and arrangement of parts may be made without departing from the scope and spirit of this disclosure.

I claim:

1. An article of furniture comprising a desk, chest or the like having a plurality of sliding drawers, a front, opposite sides, a back, a bottom and a top, said top being divided into at least a pair of top sections by fixed first upstanding wall means between said front and back, a first of said top sections being in part defined by said first upstanding wall means, a second of said top sections being defined by second upstanding wall means disposed at said back between said first upstanding wall means and one of said sides, said second top section further being defined by a cover, said cover being defined by a top panel and first side and second front depending wall means, hinge means having a horizontal axis pivotally connecting said cover to said article of furniture at said one side along said first depending wall means whereby said cover can be pivoted between a first position at which said cover is disposed sidewise away from said one side and a second position at which said cover overlies and covers a portion of said top and rests upon said first upstanding and second upstanding wall means thereby providing the appearance of a unitized immovable part of the article of furniture in conjunction with said first top section, and lavatory means within said second top section and concealed thereby when said second top section is in said second position, said first depending wall means comprising a triangular strip being attached to the end wall and under the edge of said cover to prevent water from accumulating in the exposed port area of the cover when said cover is pivoted to its upstanding opened position, the water being diverted by said triangular strip toward said lavatory, said first upstanding wall means and said first depending wall means are in generally parallel relationship to each other in said second positions; and said second upstanding wall means and said second depending wall means are in generally parallel relationship to each other.

* * * * *